US007255781B2

(12) United States Patent
Hu et al.

(10) Patent No.: US 7,255,781 B2
(45) Date of Patent: Aug. 14, 2007

(54) PRODUCTION OF ALIGNED MICROFIBERS AND NANOFIBERS AND DERIVED FUNCTIONAL MONOLITHS

(75) Inventors: Michael Z. Hu, Knoxville, TN (US); David W. DePaoli, Knoxville, TN (US); Tanya Kuritz, Kingston, TN (US); Ogbemi Omatete, New Port Richey, FL (US)

(73) Assignee: UT-Battelle, LLC, Oak Ridge, TN (US)

( * ) Notice: Subject to any disclaimer, the term of this patent is extended or adjusted under 35 U.S.C. 154(b) by 718 days.

(21) Appl. No.: 10/673,719

(22) Filed: Sep. 29, 2003

(65) Prior Publication Data

US 2004/0217010 A1 Nov. 4, 2004

Related U.S. Application Data

(60) Provisional application No. 60/467,118, filed on May 1, 2003.

(51) Int. Cl.
*G01N 27/453* (2006.01)

(52) U.S. Cl. ..... 204/469; 204/456

(58) Field of Classification Search ..... 204/450, 204/455, 456, 469, 606, 605, 600
See application file for complete search history.

(56) References Cited

U.S. PATENT DOCUMENTS 5,603,819 A 2/1997 Harris et al.
6,099,960 A * 8/2000 Tennent et al. ..... 428/367
2006/0119015 A1* 6/2006 Wehrspohn et al. ..... 264/627
2006/0133982 A1* 6/2006 Kinloch et al. ..... 423/447.3

OTHER PUBLICATIONS

Block, H., Electro-rheology, J. Physics. D: Appl. Phys. 21, 1988, 1661-1677, IOP Publishing, UK.

Bogush, G., Uniform Silica Particle Precipitation: An Aggregative Growth Model, J. Colloid and Interface Science, Mar. 1, 2001, 19-34, 142, 1, Academic Press, US.

Bogush, G., Studies on the Formation of Monodisperse Silica Powders, Ultrastructure Proc. Adv. Ceramics, 1988, 477-486, Wiley, US.

Bogush, G., Preparation of Monodisperse Silica Particles: Control of Size and Mass Fraction, J. Non-Crystalline Solids 104, 1988, 95-106, Amsterdam.

(Continued)

*Primary Examiner*—Alex Noguerola
(74) *Attorney, Agent, or Firm*—Judson R. Hightower

(57) ABSTRACT

The present invention comprises a method for producing microfibers and nanofibers and further fabricating derived solid monolithic materials having aligned uniform micro- or nanofibrils. A method for producing fibers ranging in diameter from micrometer-sized to nanometer-sized comprises the steps of producing an electric field and preparing a solid precipitative reaction media wherein the media comprises at least one chemical reactive precursor and a solvent having low electrical conductivity and wherein a solid precipitation reaction process for nucleation and growth of a solid phase occurs within the media. Then, subjecting the media to the electric field to induce in-situ growth of microfibers or nanofibers during the reaction process within the media causing precipitative growth of solid phase particles wherein the reaction conditions and reaction kinetics control the size, morphology and composition of the fibers. The fibers can then be wet pressed while under electric field into a solid monolith slab, dried and consolidated.

2 Claims, 7 Drawing Sheets

OTHER PUBLICATIONS

Colon, L., Packing Columns for Capillary Electromatography, J. Chromatography A, 887, 2000,43-53, Elsevier.
Gast, A., Electrorheological Fluids as Colloidal Suspensions, Ad. in Colloid and Interface Science, 30, 1989, 153-203, Elsevier.
Harris, M., Theoretical and Experimental Invest. of Growth of Silica and Titania Particles in Low Molecular Wt. Alcohols, Mat. Res. Soc. Symp. Proc, 271, 1992, 291-296, US.
Harris, M., Base-Catalyzed Hydrolysis and Condensation Reactions of Dilute and Concentrated Teos Solutions, J. Non-Cryst. Solids 121, 1990, 397-403, Elsevier.
Look, J., Colloidal Interactions During Precip. of Uniform Submicrometre Particles, Faraday Discuss. Chem. Soc., 90, 1990, 345-357.
Martin, J., Electrorheology of a Model Colloidal Fluid, J. Colloid and Interface Sci., 167, 1994, 437-452, Academic Press, US.
Zou, H., Mololithic Stationary Phases for Liquid Chromatography and Capillary Electrochromatography, J of Chromatography A, 2002,5-32, 954.
Luedtke, S., Towards the Ultimate Minimum Particle Diameter of Silica Packings in Capillary Electrochromatography, J of Chromatography A, 2000, 339-346, 887.
Tanaka. N., Monolithic Silica Columns for High-Efficiency Chromatographic Separations, J of Chromatography A, (2002), 35-49, 965.
Hermanson, K., Dielectrophoretic Assembly of Electrically Functional Microwires from Nanoparticle Suspensions, Science Nov. 2001, 1082-1086, 294, USA.
Fudouzi, H., Assembling 100 mm Scale Particles by an Electrostatic Potential Field, J Nanoparticle Research, 2001, 193-200, 3, Kluwer Publishing, Netherlands.
Fraden, S., Electric-Field-Induced Association of Colloidal Particles, Physical Review Letters, Nov. 1989, 2373-2376, 63, 21, USA.
Stober, W., Controlled Growth of Monodisperse Silica Spheres in the Micron Size Range, J Colloid and Interface Science, 1968, 62-69, 26, USA.
Santacesaria, E., Kinetics of Titanium Dioxide Precipitation by Thermal Hydrolysis, May 1986, 44-53, 111, No. 1, Academic Press, USA.
Mimouni, Z., Field-induced Structure in a Colloidal Suspension, Prog Colloid Polym Sci, 1990, 120-125, 81, Springer-Verlag, New York.
Pursch, M., Stationary Phases for Capillary Electrochromatography, 2000, 313-326, J of Chromatography A, 2000,887, Amsterdam.
Ratnayake, C., Characteristics of Particle-Loaded Monolithic Sol-Gel Columns for Capillary Electrochromatography, J of Chromato graphy A, 2000, 277-285, 887, Amsterdam.
Schwan, H., Interactions Between Electromagnetic Fields and Cells, NATO Advanced Research Workshop, 1984, 97, 371, Plenium Press, NY.
Sher, L., On the Possibility of Nonthermal Biological Effects of Pulsed Electromagnetic Radiation, Biophysical Journal, 1970, 970-979, 10, USA.
Svec, F., Design of the Monolithic Polymers Used in Capillary Electrochromatography Columns, J of Chromatography A, 2000, 3-29, 887, Elsevier.
Takashima, S., Alignment of Microscopic Particles in Electric Fields and Its Biological Implications, Biophysical Society, Apr. 1985, 513-518,47, USA.
Tang, Q,, Capillary Electrochromatography Using Continuous-Bed Columns of Sol-Gel Bonded Silica Particles with Mixted-Mode Octadecyl and Propylsulfonic Acid Functional Groups, J of Chromatography A, 2000, 265-275, 887, Elsevier.
Tang, Q., Monolithic Columns Containing Sol-Gel Bonded Octadecylsilica for Capillary Electrochromatography, J of Chromatography A, 1999, 35-50, 837, Elsevier.
Winslow, W., Induced Fibration of Suspensions, Applied Physics, 1949, 1137-1140, 20, USA.

* cited by examiner

PRODUCTION OF ALIGNED MICROFIBERS AND NANOFIBERS AND DERIVED FUNCTIONAL MONOLITHS

CROSS-RELATED APPLICATIONS

The present application claims the benefit of U.S. Provisional Application No. 60/467,118 filed May 1, 2003, incorporated herein by reference.

The United States government has rights in this invention pursuant to contract no. DE-AC05-00OR22725 between the United States Department of Energy and UT-Battelle, LLC.

FIELD OF THE INVENTION

The present invention relates to methods for producing microfibers, nanofibers, and solid monolithic materials, and more particularly for producing aligned microfibers, nanofibers and derived solid monolithic material that has aligned uniform microfibrils or aligned uniform nanofibrils.

BACKGROUND OF THE INVENTION

The recent emergent use of monoliths as stationary phase in chromatography and other sorption technologies, i.e. replacement of packed-bed column in capillaries with monolithic materials, has resulted in significant advancement in chromatography separation and analytical sciences (Svec et. al., 2000; Colon et. al., 2000, Zou et. al., 2002). In addition to lower pressure drop, improved separation efficiency, decreased dispersion due to thermal gradients, and faster separations, monoliths are much more reproducible in performance than packed columns in capillaries. Current monolith development in the field has been limited to organic polymeric media (e.g., styrene divinylbenzene-based materials) (Svec et. al., 2000). Inorganic materials such as functionalized silica particles have been examined as packing materials inside glass capillaries (Luedtke et. al., 2000; Tanaka et. al., 2002). A few papers reported the use of sol-gel bonded silica particles as "continuous beds" in columns or as "monoliths" inside glass capillaries or tubes (Tang et. al., 1999; Tang and Lee, 2000; Ratnayake et. al., 2000).

Major techniques used or being developed for biomolecule separations (DNA sizing and sequencing) include gel electrophoresis (GE), capillary electrophoresis (CE) and capillary electrochromatography (CEC) (Pursch and Sander, 2000). The GE/CE technique separates only charged species while the CEC separates both charged and neutral species. For GE, uniform preparation and loading of gels are labor intensive. Only limited number of samples can be loaded per gel. The gel typically used in laboratory applications is polyacrylamide; however, its monomer is very toxic and the gel is fragile. To increase the maximum number of samples, the latest development in CE utilizes bundled glass capillaries, but they are still fragile and tedious to operate. Both gels and glass capillary are not suitable for large-scale separations. Fibril monoliths are needed to enable the scale-up of capillary electrophoresis and capillary electrochromatography.

OBJECTS OF THE INVENTION

Accordingly, it is an object of the present invention to provide a method for producing aligned inorganic fibers ranging in diameter from micrometer-sized to nanometer-sized wherein the fibers have controllable diameter, morphology and composition.

It is another object of the present invention to provide a method for fabricating derived solid monolithic material having aligned uniform microfibrils or aligned uniform nanofibrils.

It is yet another object of the present invention to provide an inorganic fibrous structure ranging in diameter from micrometer-sized to nanometer-sized having increased surface area and enhanced anisotropic properties including conductivity, permittivity, optical attenuation and mechanical toughening.

It is still yet another object of the present invention to provide an inorganic fibrous structure ranging in diameter from micrometer-sized to nanometer-sized having a length-to-diameter aspect ratio of greater than 100:1.

It is a further object of the present invention to provide a solid monolithic material having aligned uniform microfibrils or aligned uniform nanofibrils having enhanced anisotropic properties including conductivity, permittivity, optical attenuation, mechanical toughening and permeation.

It is another object of the present invention to provide a solid monolithic material having aligned uniform microfibrils or aligned uniform nanofibrils having tailored capillary-like channels ranging in diameter from micrometer-sized to nanometer-sized thereby increasing the volumetric capacity of the monolithic material.

It is yet another object of the present invention to provide a solid monolithic material having aligned uniform microfibrils or aligned uniform nanofibrils having a surface chemistry capable of being tailored for various organic ligand grafting.

It is still yet another object of the present invention to provide a new and useful electrophoretic media having desirable anisotropic properties including transport characteristics for biomolecule separation.

It is a further object of the present invention to provide a new and useful catalyst comprising a solid functional monolithic material.

It is another object of the present invention to provide a new and useful ion exchange resin comprising a solid functional monolithic material.

It is yet another object of the present invention to provide a new and useful electronic device comprising a solid monolithic material.

These and other objects, features and advantages of the present invention will become apparent after a review of the following detailed description of the disclosed embodiments and the appended claims.

SUMMARY OF THE INVENTION

In accordance with one aspect of the present invention, the foregoing and other objects are achieved by a method for producing fibers ranging in diameter from micrometer-sized to nanometer-sized, comprising the steps of producing an electric field and preparing a solid precipitative reaction media wherein the media comprises at least one chemical reactive precursor and a solvent having low electrical conductivity and wherein a solid precipitation reaction process for nucleation and growth of a solid phase occurs within the media. Then, subjecting the media to the electric field to induce in-situ growth of fibers ranging in diameter from micrometer-sized to nanometer-sized during the reaction process within the media causing precipitative growth of solid phase particles wherein the reaction conditions and reaction kinetics control the size, morphology and composition of the fibers.

In accordance with another aspect of the present invention, other objects are achieved by an inorganic fibrous structure ranging in diameter from micrometer-sized to nanometer-sized, the fibrous structure having increased surface area and enhanced anisotropic properties including conductivity, permittivity, optical attenuation and mechanical toughening. The inorganic fibrous structure has a length-to-diameter aspect ratio of greater than 100:1.

In accordance with yet another aspect of the present invention, other objects are achieved by a solid monolithic material comprising aligned uniform fibrils ranging in diameter from micrometer-sized to nanometer-sized and having enhanced anisotropic properties including conductivity, permittivity, optical attenuation, mechanical toughening and permeation. The monolithic material having tailored capillary-like channels ranging in diameter from micrometer-sized to nanometer-sized thereby increasing the volumetric capacity of the monolithic material. The monolithic material having a surface chemistry capable of being tailored for various organic ligand grafting.

Figure 1A:
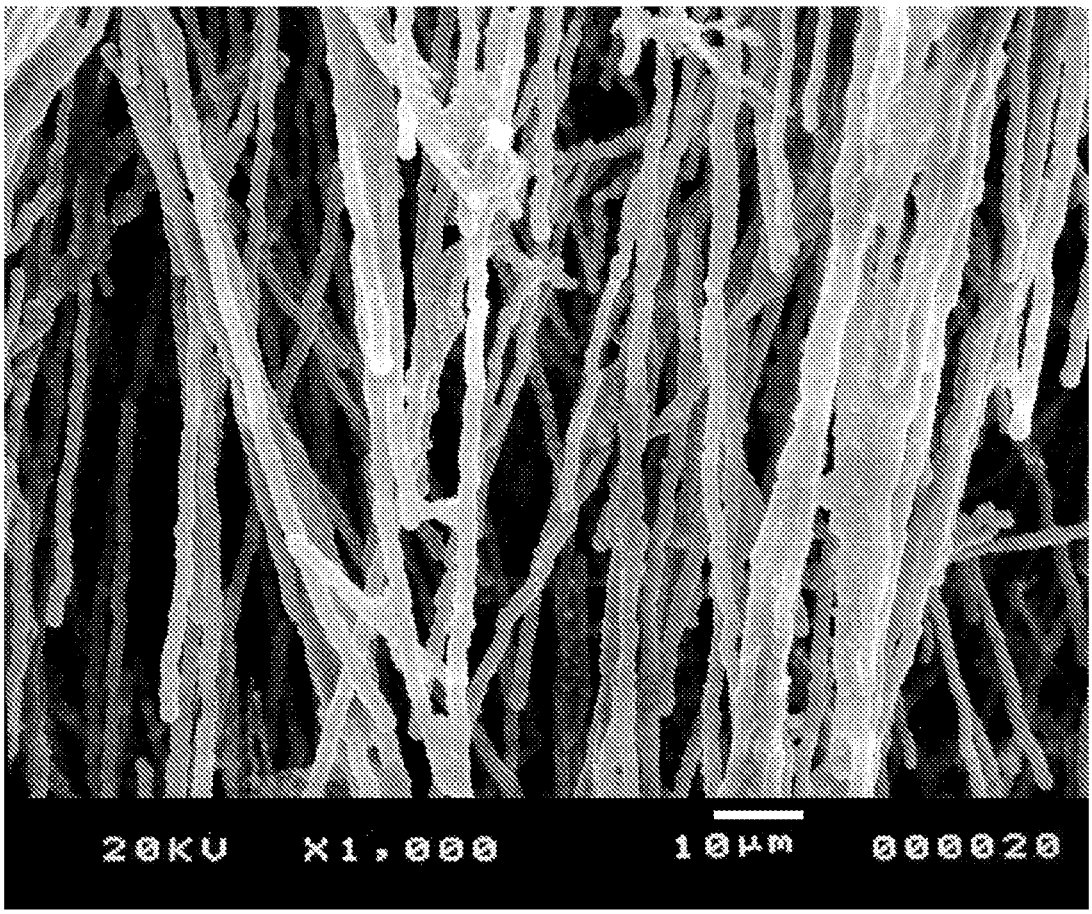
FIG. 1*a* is an SEM micrograph showing individual straight fibers that are single hair-like fibers made by the method of the present invention, electric field-induced growth in reactive media.

For a better understanding of the present invention, together with other and further objects, advantages and capabilities thereof, reference is made to the following disclosure and appended claims in connection with the above-described drawings.

DETAILED DESCRIPTION OF THE INVENTION

Solid monolithic materials that have aligned fibril microstructure offer diverse, unique applications due to their anisotropic properties (mechanical strength, optical, electrical and sorption/transport, etc.). It is believed by Applicant that inorganic monoliths (particularly silica-based materials) offer better separation performance because of their material durability/stability and silica surface chemistry that can be tailored for various organic ligand grafting. Fibril monoliths are needed to enable the scale-up of capillary electrophoresis and capillary electrochromatography, the two major separation and identification techniques used in DNA sequencing and other biotechnology applications. In addition, new technology for forming fibril monoliths have potential impact on the development of advanced materials such as fiber-reinforced structural or functional composites. The present invention presents a "bottom up" approach to grow a new class of inorganic long microfibers or microwires and to form oriented arrays of microfibers perpendicular to a solid substrate surface. Reactive molecular species are utilized as "building blocks" for the field-directed, self-assembled growth of microfibers driven by a pulsed-DC electric field. This reactive electrofibrilation process combining external field with a solid-phase nucleation and growth process, such as the process involved sol-gel reaction chemistry, enables bulk production of long microfibers or nanofibers of a whole spectrum of inorganic materials (oxides including mixed oxides, metals and organic polymers). Further, the methodology of the present invention provides for the fabrication or production of monolithic materials containing aligned microfibers or even aligned nanofibers, directly from chemical solution precursors, which involve steps of oriented micro- or nanofiber formation and wet pressing under an applied field. The electrofibrilation and wet pressing methodology of the present invention avoids the requirement of a casting step in monolith fabrication as required by the conventional ceramic casting process. The methodology of the present invention offers the ability to synthesize bulk quantities of long, individual microfibers with controllable diameter, morphology and composition. Macroscopic (1 cm×1 cm×3 mm) microfiber monoliths have been made, consolidated at high temperatures, and tested as electrophoretic media for DNA fragment separation. The results obtained from biomolecular separations demonstrated desirable anisotropic transport characteristics. The methodology of the present invention can be applied for the production of nanofibers and derived monolithic materials containing aligned fibril nanostructure by changing process parameters or reaction conditions and reaction kinetics.

"Bottom up" fabrication has been considered as an important methodology for microfabrication and nanofabrication of advanced materials and miniaturized devices having potential applications in the electronic, optical or optophotonic, and biochemical fields. Assembly of organized structures from colloids and nanoparticles (as building blocks) as well as self-assembly of molecules that takes advantage of physicochemical interactions between surfactant molecules, have attracted a lot of attention as major built-up processes for making desirable functional structures. Examples include one-, two-, and three-dimensional structures based on self/directed assembled particles and nanoporous (zeolites) and mesoporous materials (MCM41) by molecular templated synthesis.

For almost all the micro- or nano-systems, it demands controlled built-up of inorganic precursor materials in the desired location, shape and quantity. The molecular assembling growth scheme provides more refined control such as in size and morphology than particle-based assembling. Therefore, nucleation and growth of a particular inorganic solid phase from molecular precursors (rather than use of pre-made particles) can be very promising phenomena to aid the bottom-up fabrication, possibly adding one molecule at a time. In the present invention, it is demonstrated that reactive molecular species, which is much smaller than nanoparticles, can be suitably used as building blocks. The "assembly" of reactive species guided by an external force, such as electric field, leads to more precisely (at molecular addition level) tailored growth of an inorganic solid phase with controlled sized and morphology, i.e., long microfibers oriented along the fieldline direction.

Charged particle or molecule movement driven by an electric field is known as electrophoresis (EP), which has been utilized for particle deposition and biomolecule separation via polymer gels. The other fundamentally important interaction that the electric field could offer is called the dielectrophoresis (DEP), which also affects the movement of a small particle or even a molecule. DEP is the translational motion of neutral matter caused by polarization effects in a non-uniform electric field, typically created by one or more pairs of oppositely charged electrodes. The fundamental principle of EP and DEP are well understood. The induced dipole-dipole interactions between particles lead to the formation of chains or fibrils parallel to the applied electric field. DEP allows manipulation of objects in a way that both the direction and velocity of the DEP-force (hence the direction and velocity of particle motion) can be controlled with proper selection of particle/medium system, operating conditions (frequency and voltage), and electrode configuration. Therefore, electric field can be considered as a great tool to manipulate the movement and assembly of "particles", which could be as small as single molecules or molecular clusters/species.

Previously, electric fields have been used to assist controlled assembly, organization, or patterning of particles (such as colloids, nanoparticles, and biological cells and viruses); to align dispersed particles into chains during engineered processing of particle-filled polymer composite materials; to create particle chains in electrorheological fluids; to direct microphase separation of block copolymers, to induce orientation of liquid crystalline materials; to trap DNA molecules; and to affect crystallization and oriented film growth. For example, Hermanson et. al., (2001), prepared one-dimensional "microwires" based on dielectrophoretic assembly or aggregation of gold nanosphere particles. Fudouzi et. al., (2001), also suggested that dielectrophoresis plays an important role in their process of depositing dielectric or conductive particles on the electrified pattern on a substrate surface. However, electric field has not yet been coupled with a real-time solid phase formation via nucleation and growth from reactive precursor molecules in solutions under mild conditions.

It is known that colloidal metal-oxide particles can be formed by the hydrolysis/condensation and controlled aggregation of subunits that include oligomers, soluble polymers, and insoluble polymers or nuclei (Santacesaria et. al., 1986; Bogush and Zukoski, 1991; Look et. al., 1991; Harris et. al., 1992; Harris, 1992; each respectively incorporated herein by reference). These subunits aggregate into spherical nanoparticles or microparticles (Takashima and Schuwan, 1985). Because of electrostatic repulsive forces, larger particles are colloidally stable while particle growth occurs by the deposition of the subunits on the surface of the particles (Harris et. al., 1990). Due to colloidal stability, the microparticles produced are usually in discrete/dispersed forms. There is a large body of literature on the synthesis of monodispersed, submicrometer silica microspheres by nucleation and growth in a mixed alkoxide-water-alcohol solution.

Previous research results have shown that premade colloidal particles in a suspension can be aligned into particle chains in the presence of an external (electric or magnetic) field (Winslow, 1949; Schwan, 1984; Sher et. al., 1970; Fraden et. al., 1980; Mimouni et. al., 1990). Excellent reviews on the particle-alignment phenomenon in external field have been given by Block and Kelly (1988) and Gast and Zukoski (1989). Application of an external field during chemical precipitation synthesis may change the morphology of the solid products from the hydrolysis/condensation reactions in solution.

The present invention utilizes this field-induced alignment phenomenon to form linear aggregates from the reactive subunits and larger particles by field-controlled nucleation, chaining aggregation, and growth. In situ oriented growth of solid along the field direction results in continuous solid fibers. Seeded growth is an idea to bypass the time requirement for particle growth and thus enhance the fibril structure growth kinetics. Premade seed particles (microspheres) are aligned in the field and then reactive precursors in solution coat the particle surface with solid layers, which connect neighboring particles that are linearly aligned by the external field.

In the past, Harris et. al., (1990), and Harris, 1992, observed the formation of small quantities of non-uniformly sized fibril-like silica in an electric field during the base-catalyzed hydrolysis and condensation of tetraethylorthosilicate (TEOS) in tert-amyl alcohol. The as-prepared fibrils contained particles that are connected together along aligned direction and these fibril structures are stable. However, past methods generate only fibril-like silica aggregate particles (not real individual microfibers) and insufficient quantities for applications. In the "electrohomogeneous precipitation," reported earlier by Harris, 1992, the fibrils generated are not uniform (with varying lengths and diameters). Further, the fibrils were aggregated/fused, linearly aligned microsphere particles, and no individual long microfibers have ever been obtained. The present invention provides the methodology for the formation or production of in-situ aligned uniform microfibril structure and aligned uniform nanofibril structure in bulk volume of reactive precipitation media and subsequent steps to make solid monoliths from the grown microfibrils and nanofibrils.

In the present invention, field-guided assembly has been shown to occur at the molecular level and cross-linking between the assembled reactive molecular species can be applied to the guided growth of desirable material structures, i.e., long continuous microfibers (instead of one-dimensional aggregates of attached/discrete particles as reported in the literature). In the following examples, these chemicals and solutions were used as received: tetraethylorthosilicate (TEOS) (Baker Analyzed, J. T. Baker, Phillipsburg, N.J.), ethanol (Absolute 200-Proof, AAPER Alcohol & Chemical Co., Shelbyville, Ky.), t-amyl alcohol (tAA) (Baker Analyzed, J. T. Baker, Phillipsburg, N.J.), strong ammonia solution (SAS) (25-30 wt % of $NH_3$, 14.8 M $NH_4OH$, ~0.9 g/cm$^3$ contains 35 M $H_2O$) (EM Science, Gibbstown, N.J.) were all used as received. For the preparation of TEOS solution in alcohol, predetermined weight of TEOS liquid was weighed in a volumetric flask before the addition of alcohol to the marked volume. For preparation of aqueous ammonia solution in alcohol, predetermined volumes of water and SAS were pipetted into a volumetric flask before the addition of alcohol to the marked volume.

For the present invention, a typical sol-gel reaction (amorphous solid silica nucleation and growth process) was chosen to illustrate the principle of directed built up or growth of desirable material structures. The classical Stöber silica microsphere synthesis reaction, which has been used as a model system for many fundamental studies, involves the base-catalyzed hydrolysis and condensation reactions of tetra ethoxy silane (TEOS, $Si(OR)_4$ where $R{=}C_2H_5$) in an alcohol:

$$Si(OR)_4+xH_2O \rightarrow Si(OH)_{4-x}+xROH \quad \text{(Hydrolysis)}$$

$$\equiv Si—OH+OH^- \rightarrow \equiv Si—O^-+H_2O \quad \text{(Ionization of hydrolyzed monomers)}$$

$$\equiv Si—OH+HO—Si\equiv \rightarrow Si—O—Si\equiv+H_2O \quad \text{(Water-producing condensation)}$$

$$\equiv Si—OR+HO—Si\equiv \rightarrow \equiv Si—O—Si\equiv+ROH \quad \text{(Alcohol-producing condensation)}$$

Here, ammonia serves as a base catalyst and alcohol such as ethanol or tert-amyl alcohol (tAA) is the solvent. The tAA, having a low electrical conductivity (0.54 nano mho/cm) which is compatible with the sol-gel reaction due to its water miscibility (soluble in approximately 8 parts of water), was used for all the experiments that involve the application of electrical field. Low electrical conductivity of solvent reduces Joule heating and is required for field-induced polarization and particle chaining phenomena to occur.

Particles synthesized free of electric field. To optimize homogeneous nucleation and growth of silica, two equal volumes of solutions (TEOS-alcohol and $H_2O$—$NH_3$-alcohol) were mixed vigorously by hand. For the synthesis of monodispersed silica microspheres, a typical solution formulation is: 0.17 M TEOS, 2 M $NH_3$, 7 M $H_2O$, ethanol as solvent, at room temperature (~25° C.). In the calculation of water molar concentration in the final reaction mixture, the water in strong ammonia solution must be considered. Part I (0.2 M TEOS in tAA) was mixed with equal volume of Part II solution (1.4 M $NH_3$ –12 M $H_2O$ in tAA) in glassware to form a reactive mixture containing 0.1 M TEOS, 0.7 M $NH_3$, 6 M $H_2O$, tAA as solvent, at room temperature. The aqueous ammonia did not dissolve in tAA completely in Part II solution (due to the solubility limit of tAA in water: one part of tAA is approximately soluble in 8 parts of water) and thus formed a cloudy emulsion after hand shaking or ultrasonication. However, after mixing Part I and Part II, the reactive mixture turned clear under the conditions used.

SEM images of particles obtained from these experiments showed that as conditions changed from 0.1 M TEOS, 6 M $H_2O$, 0.7 M $NH_3$ to 0.17 M TEOS, 7 M $H_2O$, 2 M $NH_3$, particle size increased from 200 to 250 nm while maintaining good monodispersity. Further increase of TEOS concentration to 0.4 M resulted in agglomerated large particles with primary particle size of 530 nm.

Field-induced chaining/alignment of premade particles. Premade particles obtained from hydrolysis/condensation in ethanol as described above were harvested by centrifugation, washed with tAA, and then redispersed in tAA to form a thick, white slurry or suspension. Joule heating adversely affected the reactive electrofibrilation (i.e., precipitative growth of microfibrils in external field), as previously described by Harris et. al., (1992). Tert-amyl alcohol was chosen to reduce the electrical conductivity of the particle suspension or reaction medium and thus reduce Joule heating when the suspension or reaction mixture is subjected to an electric field. Low electrical conductivity of solvent is required for field-induced polarization and particle chaining phenomena to occur. To observe the particle chaining effect, the appropriately diluted particle suspension in tAA was placed in a thin optical quartz cell (1-mm sample path thickness, 45 mm long, and 10-mm wide). Two 1-mm-diameter steel wire electrodes were inserted in the internal sides of the cell with 8-mm parallel spacing. A pulsed DC supply that approximates an alternating current signal (10-13 kV with pulse frequency of 1-10 kHz) on the electrode was found to effectively induce particle alignment. Field-induced chaining in suspensions of premade particles was monitored by a long-distance microscopic camera, displayed on a TV screen, and images were recorded in time on a VCR tape.

The homogeneous sol-gel reaction, free of electric field, as described above, produced monodispersed microspheres due to colloidal stability. It is believed that the growth of a microsphere is either through molecular monomer diffusion-addition mechanism or through nanocluster aggregation mechanism. In both mechanisms, one phenomenon may be in common, viz., the deposition of small species (single molecule or polymeric molecular clusters) onto the surface of an existing solid particle contributes to its size growth. Monodispersed microsphere particles were prepared for the ensuing studies of particle chaining and alignment by an external field. The general conditions for silica microsphere synthesis from hydrolysis and condensation reactions of TEOS in ethanol were identified: TEOS (0.17-0.5 M), $H_2O$ (0.5-14 M), $NH_3$ (0.5-3 M), and temperature (room temperature to elevated temperatures). It was found that the size of microspheres (d, m) produced at a reaction temperature of 25° C. depends on the reactant molar concentrations according to: $d=A(H_2O)^2\exp(-\beta(H_2O))$, where $A=(TEOS)^{-1/2}(-1.042+40.57(NH_3)-9.313(NH_3)^2)$ and $\beta=0.3264-0.2727(TEOS)$. By varying reaction conditions, nanosized particles can be produced by the same hydrolysis/condensation chemistry.

Electric fields were applied on suspensions of premade silica microspheres (~250 nm diameter) using 0.17 M TEOS, 7 M $H_2O$ and 2 M $NH_3$ in ethanol. Efforts were made to search for an organic solvent that has low electrical conductivity as well as compatibility with the hydrolysis/condensation reactions of TEOS. Electrical conductivity measurements for various solvents are shown in Table 1. Among solvents tested, tert-Amyl alcohol has the lowest electrical conductivity (0.54 nano mho/cm. Various types of electrical voltage signals, including DC and pulsed DC, were initially applied to see their field effect. DC field (0-3 kV) failed to align particles while significant particle aggregation/flocculation was observed under field-induced convective flow. The aggregated particle clusters settled very quickly due to the effect of DC field. Meanwhile, particle deposition onto the grounded electrode plate was observed, most likely due to electrophoretic effects. Martin et. al., (1994), previously explained such effects in DC field. The observation of the effects of DC field on particle alignment obtained by Applicant however, disagreed with Harris' earlier finding (1992) that DC field helped particle alignment and fibril aggregates formation. In the present work, a pulsed DC supply that approximates an alternating current signal (10-13 kV with pulse frequency of 1-10 kHz) on the electrode was discovered to effectively induce particle alignment in the tAA suspension between two parallel plate electrodes, with particle chains perpendicular to the electrode plate surfaces. No particle aggregation and electrophoretic movement were observed. The alignment structure along the field developed with time and progressed away from the electrode plate (growing into the bulk suspension). The structure was "frozen" like a stiff solid when the DC pulse frequency is above 10 kHz. Lower pulse frequency in the range of a few kHz gave faster alignment kinetics and greater fibrillation penetration depth from the plate electrode. Visually, the alignment structure spanning across the solution between two electrodes was observed at the end of a run. The "frozen" structure that was aligned under the field collapsed immediately after the field was turned off and became more fluid-like. However, "microfibrils" (actually chained particles, either single-chain or columns of assembled parallel chains) were clearly seen during the collapsing process. Since in the situation, the "microfibrils" were temporarily assembled particles along one direction (there is no material bonding between microsphere particles in the temporary fibril structures), they are not stable and eventually disappear with time due to entropic effect, i.e., spontaneous thermal diffusion into homogeneously dispersed suspension. The collapsed suspension can be repeatedly realigned by the pulsed DC field. Each time when the field was applied, the suspension fluid was suddenly "frozen", giving a stiff, solid-like aligned structure. One observation is that the light transmission through the aligned structures is greater than that through the homogeneous suspension.

TABLE 1

Electrical Conductivities of Various Alcohol Solvent.

| Solvent | Conductivity (nano mho/cm) | Solubility in Water |
|---|---|---|
| Ethanol (200-proof, fresh) | 180 | Completely soluble |
| Ethanol (200-proof, exposed to air for several times) | 500 | Completely soluble |
| Methyl Ethyl Ketone (MEK) | 210 | Completely soluble |
| Tert Amyl Alcohol (tAA) | 0.54 | Soluble in 8 parts of water |
| Cyclohexanol | 54 | 3.6 wt. % soluble in water |
| 2-Methyl-1-Pentanol | 150 | Partially soluble |
| Dowanol | 340 | Soluble |

Tert-amyl alcohol was studied for its effect on the hydrolysis/condensation reactive formation of silica particles from TEOS. Near monosized microsphere-shaped silica particles (with slight aggregation) were produced in synthesis solution containing 0.1 M TEOS, 6 M $H_2O$, and 0.7 M $NH_3$ in tAA at room temperature. When the reactant concentrations are increased (e.g., 0.17 M TEOS, 7 M $H_2O$ and 2 M $NH_3$), the particle formation kinetics and solid yield are enhanced, increased particles size distribution (200 nm to 1 micrometer) and particle agglomeration. For the same synthesis condition, the particle size obtained in tAA (~600 nm primary microsphere size) is much larger than that in ethanol (250 nm). The trend of larger particles sizes in higher alcohols such as butanol or propanol has been reported previously by Stöber et al. (1968). Induction period (the time required for visual observation of initial clear reaction solution to turn turbid) was used as a measure for the kinetics of nucleation of solid. Table 2 shows that increasing concentration of ammonia and water significantly accelerated the precipitation kinetics (i.e., shorter induction period). In these reaction conditions shown in Table 2, there were always particle aggregates observed in the precipitated particles.

TABLE 2

Precipitation kinetics of base-catalyzed TEOS hydrolysis/condensation in tAA at room temperature.

| | TEOS (M) | $H_2O$ (M) | $NH_3$ (M) | Induction Period (min) | Observation |
|---|---|---|---|---|---|
| Condition 1 | 0.2 | 2.0 | 0.22 | 60 | Observe dilute flocs before seeing uniform turbidity in bulk solution |
| Condition 2 | 0.1 | 2.0 | 0.7 | 40 | Diluted floc, heterogeneous nucleation/growth observed on wall of glass vial before seeing uniform turbidity in bulk soln. |
| Condition 3 | 0.2 | 2.0 | 0.7 | 30 | Same as condition 2 |
| Condition 4 | 0.2 | 5.0 | 1.0 | 11 | No floc formation and uniform bulk precipitation (with particle aggregation) |
| Condition 5 | 0.2 | 4.86 | 2.0 | 4 | Homogeneous bulk precipitation (with some particle aggregation), in 10 min soln turns very turbid |
| Condition 6 | 0.2 | 5.0 | 0.2 | 10 to 20 | In 50 min., bulk soln turns very turbid (homogeneous precipitation) |

Experiments were conducted to show that the pulsed DC field could induce in-situ growth of bulk-quantity microfibers during hydrolysis/condensation reactions in solutions causing precipitative growth of silica. Application of an external field during the nucleation of silica by the sol-gel precipitation changed the morphology of the solid products from the hydrolysis/condensation reactions in solutions. Furthermore, as can be seen from the following examples, individual fibers (single hair-like fibers) were made for the first time with pulsed DC field (typically 1-2 kV at 4.5 kHz), see FIG. 1*a* for straight fibers and FIG. 1*b* for fused-microsphere-like fibers. The microfiber morphology (shape and diameter) and microfiber composition can be controlled by varying synthesis conditions and reaction kinetics, wherein nanofibers can also be made.

EXAMPLE 1

Field-assisted synthesis of microfibers. Initially, a relatively slow reactive solution was used containing 0.2 M TEOS, 2.0 M $H_2O$ and 0.22 M $NH_3$ in tAA (i.e., Condition 1 in Table 2) in a thin (1-mm) quartz cuvette at room temperature, with a pulsed DC field (11.2 kV, from −4.6 kV to 6.6 kV at 4.5 kHz). It was observed that the initially clear solution did not turn cloudy; however, solid fibrils (with direction perpendicular to the electrode plate surface) gradually grew and accumulated on the high-voltage electrode (notice: the other electrode was grounded) and the rest of the solution remained clear for one hour. It seems that the solid nuclei, once generated in solution, tend to be attracted toward the high-voltage electrode surface, forming a layer or oriented microfibril arrays. The microfibril layer grew thicker in one to two hours, while the region near the ground electrode remained clear. This example suggested that oriented microfibril arrays can be grown on the electrode surface.

In order to enhance the yield and kinetics of fibrils in the electrofibrilation reactor, several factors were considered: 1) use of higher TEOS concentration and faster reaction conditions (such as higher concentration of ammonia or water); 2) seeded growth (i.e., concentrated suspension of premade particles in reactive solution) in field; and 3) use of larger electrofibrilation reactor volume. Therefore, another in-situ reactive electrofibrilation example is given below with faster kinetics:

EXAMPLE 2

A solution containing 0.2 M TEOS, 4.86 M $H_2O$ and 2.0 M $NH_3$ in tAA (Condition 5 in Table 2) was used in the thin (1-mm path) quartz cuvette at room temperature, pulsed DC field (4.5 kHz). When the applied voltage is too high (~10 kV), Joule heating due to the higher conductivity of reactive solution (TEOS-$H_2O$—$NH_3$-tAA) relative to the pure tAA solvent used in the earlier particle alignment experiments caused solvent evaporation, which generated bubbles that stirred up the bulk solution in the cuvette reactor. Fluid flow in the solution caused the failure of electric field alignment during the in-situ precipitative solid particle formation. However, at lower voltage (1.84 kV), the bubbling from solution was reduced significantly. During the reaction, there were only a few small bubbles evolving from the high-voltage electrode surface, and this did not disturb the static structure of the precipitated gels. Thick precipitate gel solid that spans between electrodes was formed after 40 min. reaction time under applied field. Microscopic examination of the as-prepared cotton gel-like solid (FIG. 1*b*) reveals that the gel solid contains parallel, aligned microfibers (consisting of connected particles).

It was determined that the redispersed microfibrils in tAA can not be linearly aligned by the pulsed DC field due to field-induced fibril aggregation/flocculation and electrophoretic movement toward the high-voltage electrode.

Figure 1B:
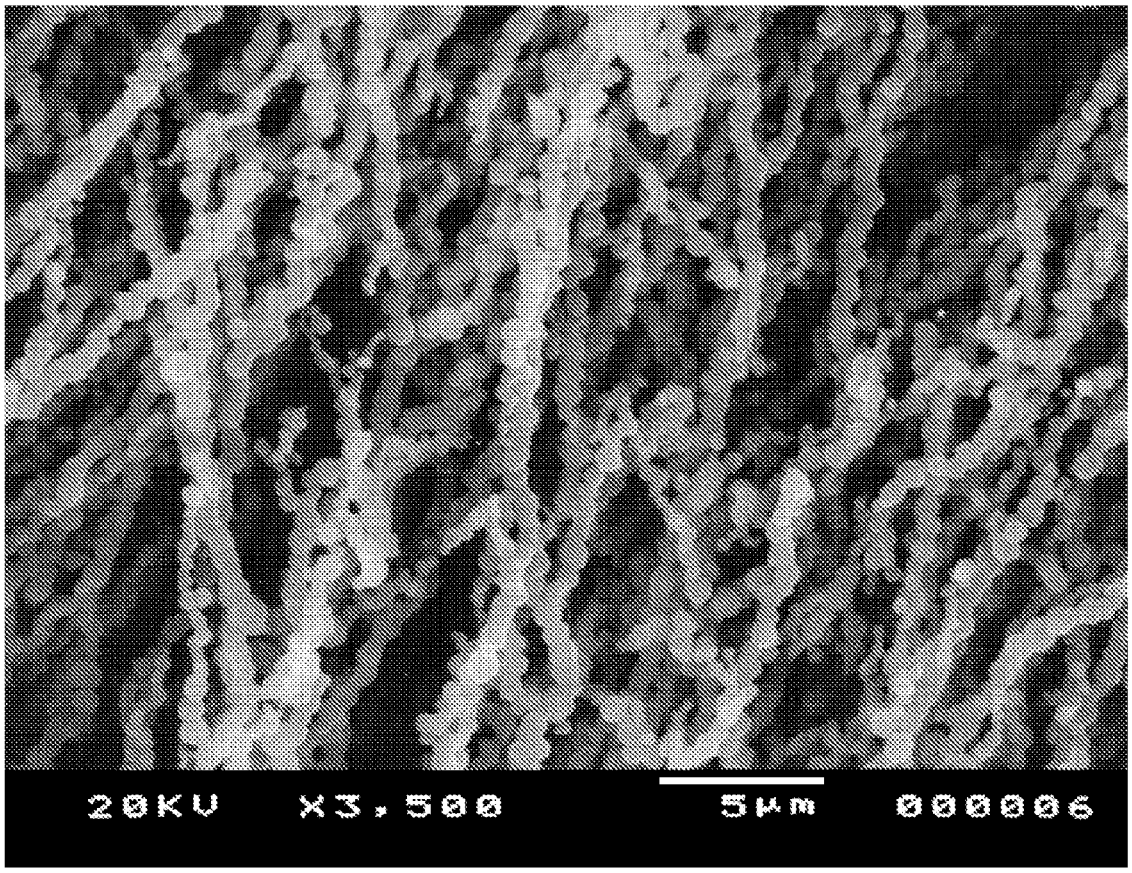
FIG. 1*b* is an SEM micrograph of a pressed solid monolith slab showing individual fibers that are fused-microsphere-like fibers aligned in one direction in the pressed solid.

Morphology of the microfibers can be tailored by controlling reaction kinetics. SEM micrographs of as-prepared solid from reaction of 0.2 M TEOS, 5.0 M H2O, and 0.2 M NH3 in tAA (Condition 6 in Table 2) in 1-cm path cuvette electrofibrilation reactor (~2 kV, 4.5 kHz) are shown in FIG. 1*a*. Near-perfect, straight microfibers were obtained after 2.5 hr. reaction. When the ammonia concentration in the reaction medium was decreased, the microfiber morphology changed from linearly connected microsphere particles (as shown in FIG. 1*b*) into true, continuous straight fibers (FIG. 1*a*). The distance between connected particles in the linear fibers is reduced and essentially no obvious microsphere curvatures appear on the walls of microfibers. Structures based on the particles assembly, such as those one-dimensional "microwires" (i.e., one-dimensional weak aggregates of particles) reported by Hermanson et. al. (2001) and Fudouzi et. al. (2001), are not permanent and thus it requires post-assembly cross-links between particles to fix a structure. Otherwise, upon the release of electric field, the temporarily aggregated particle structure will fall apart due to disrupting forces such as Brownian motion. In contrast, the real-time reactive nucleation and growth process of the present invention creates permanent structures because growth of a solid phase is based on the cross-linking and bonding of precursor molecular species.

Mechanisms of field-directed growth of fibers from clear reactive solutions may be understood as follows. In general, the electric force, F, acting on an individual cluster or particle, includes two terms (electrophoretic and dielectrophoretic forces): $F=QE+(P\circ\nabla)E$, where Q is the particle charge, E is the field strength, and P is the particle dipole moment being proportional to the field strength. In the electric aligning test using premade particles with regular DC, it was observed that the layer of particles always build up from the surface of high voltage electrode toward the ground electrode. However, in pulsed DC field, which simulates AC field, the time-average electrophoretic force vanishes whereas the interaction of the induced dipole in the cluster/particle with the electric field generates a DEP electrostatic force, $F_p=(3/2)\Lambda_p\gamma_f\exists\nabla E^2(r, t)$. Here $\exists=(\gamma_p!\gamma_f)/(\gamma_p+2\gamma_f)$ is the polarizability of a particle, $\Lambda_p$ is the particle volume, and $\gamma_p$ and $\gamma_f$ are respectively, the dielectric constants of the particle and of the background fluid where the permittivity of the vacuum $\gamma_0$ is included as a multiplier in the definition of the dielectric constant. The DEP is the electric-field-induced motion of polarized but electrically uncharged particles in nonuniform electric field E(r, t). DEP force depends primarily on the differences between the values of the dielectric constant and of the conductivity of the particles and those of the background fluid. Particle chaining in our test system is similar to the electrorheological (ER) phenomena, in which induced polarization occurs due to sufficient permittivity or permeability mismatch between particles/clusters and solvent and polarized particles/clusters align along the field line. In regarding to the fiber growth mechanism, both ER chaining and positive DEP of silicate molecular clusters could occur. In the beginning stage, clusters align into chains and aggregate and accumulate into a fibril. Once the silica fibrils form, they could function like a wire electrode due to relative high conductivity and polarizability of the silica materials than the background tAA solvent medium. Other free clusters could then aggregate onto the fibril tip toward the ground electrode. Positive DEP tends to concentrate clusters/particles in regions where the electric field intensity is high (typically the tips of the "electrodes").

To study the effect of electrode plate area and reaction solution volume on the microfibril formation, a 1-cm-path quartz cuvette was used as the in situ electrofibrilation reactor. The volume in this reactor is 10 times that of the 1-mm path quartz cuvette used in the above examples. In this case, solid collected after 1.5 hour reaction under a near-AC pulsed DC (~1 kV, 4.5 kHz) field was dispersed in tAA for SEM sample preparation. Again, microfibers were successfully produced in the 1-cm path cuvette electrofibrilation reactor using reaction solution containing 0.2 M TEOS, 5.0 M $H_2O$, and 1.0 M $NH_3$ in tAA at room temperature. One significant finding is that the solid microfibril gel generated in the cuvette can be easily separated from the background solvent, just like harvesting wet cotton fibers from water. This finding led to a new way of concentrating and pressing/packing such fibril gel solid into a pressed solid that is "wet-pressing by a piston". Note that without such microfibril structure, homogeneously precipitated particle gel cannot be separated and pressed in such a manner.

EXAMPLE 3

Two equal volumes of the solutions (TEOS-tAA and water-ammonia-tAA) were mixed vigorously by hand and poured into the electrofibrilation cell. The electrofibrilation cell is a standard quartz cuvette of either 1-mm path (1 mm×10 mm×45 mm) or 1-cm path (10 mm×10 mm×45 mm) with two parallel-steel-plate (~1 mm thickness) electrodes attached to the side walls. To enhance the rate of solid microfiber production, some pre-made silica microsphere particles were used as seeds in reaction solution (Condition 6, Table 2). The effect of seeding on nucleation, growth, aligned particle-particle connection during reaction under field, and eventually on the microstructure of the fibrils was studied. Such seed-solution mixtures were subjected to no field (as control) or 1.5 kV pulsed DC field (4.5 kHz). SEM examination of solid samples collected after 1.5 hours clearly indicated that microfibers consisting of connected microsphere particles were obtained due to pulsed DC field alignment.

Figure 2:
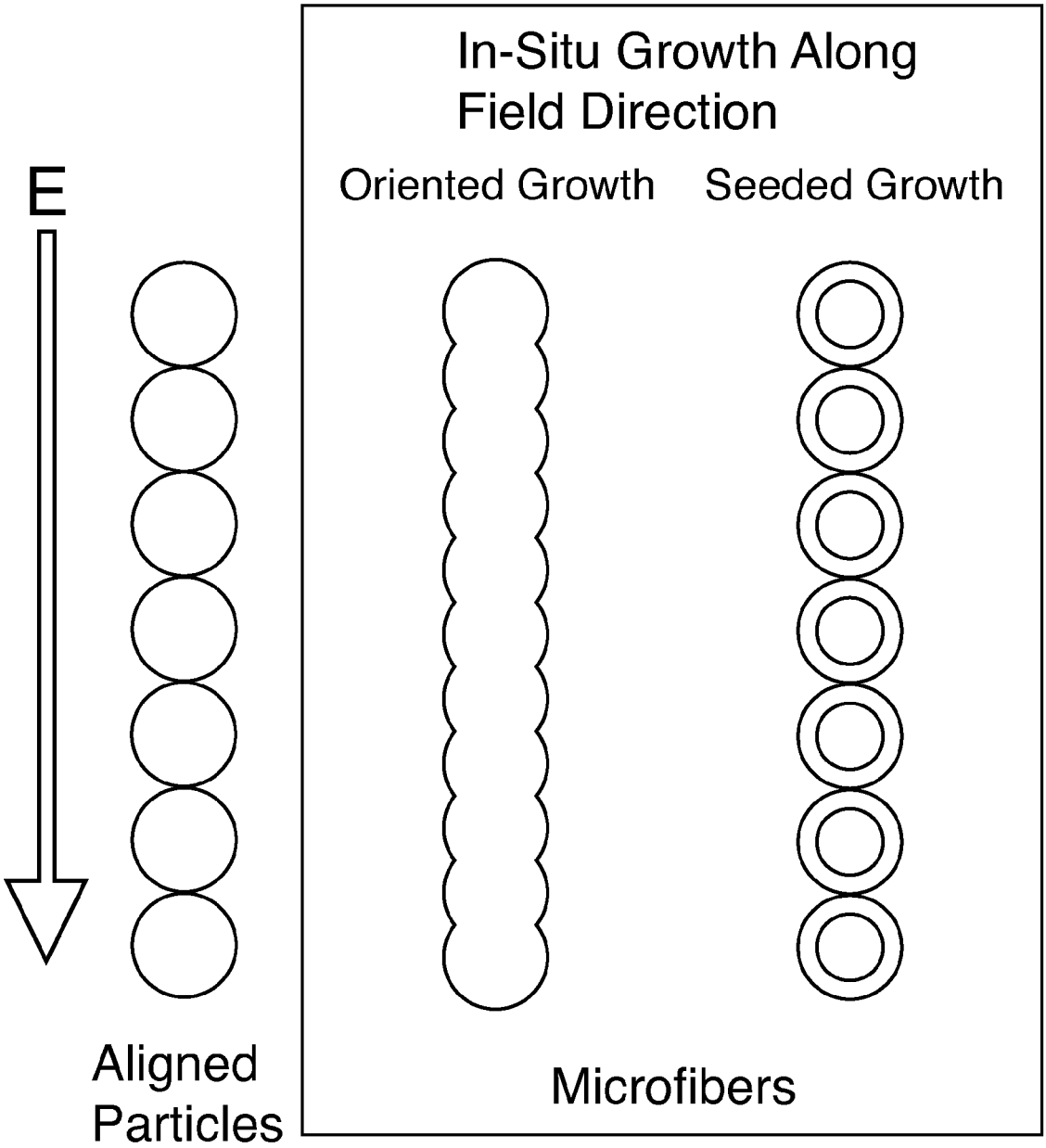
FIG. 2 illustrates the microfiber or nanofiber synthesis based on the field-induced nucleation and growth of solids and particle chaining phenomena of the present invention.

The above example demonstrates the possibility of using reactive sol-gel precipitation to coat and "glue" the neighboring microspheres that are already aligned and attached each other by the pulsed DC field (illustrated in FIG. 2). The fiber structure of "linearly connected microspheres" is permanent, and stayed in precipitated gel solids even after the field was turned off. The seeded-growth approach takes advantage of both particle-chaining phenomena and sol-gel reactive precipitation that coats/deposits silica on the surfaces of chained microspheres and glues them together to form a permanent microfiber. Of course, microfibers were also generated in the solution due to precipitative nucleation and growth from inorganic soluble precursors in an applied field. This microfiber formation mechanism does not harm the microfiber formation from seeded microsphere particles.

EXAMPLE 4

Figure 3A:
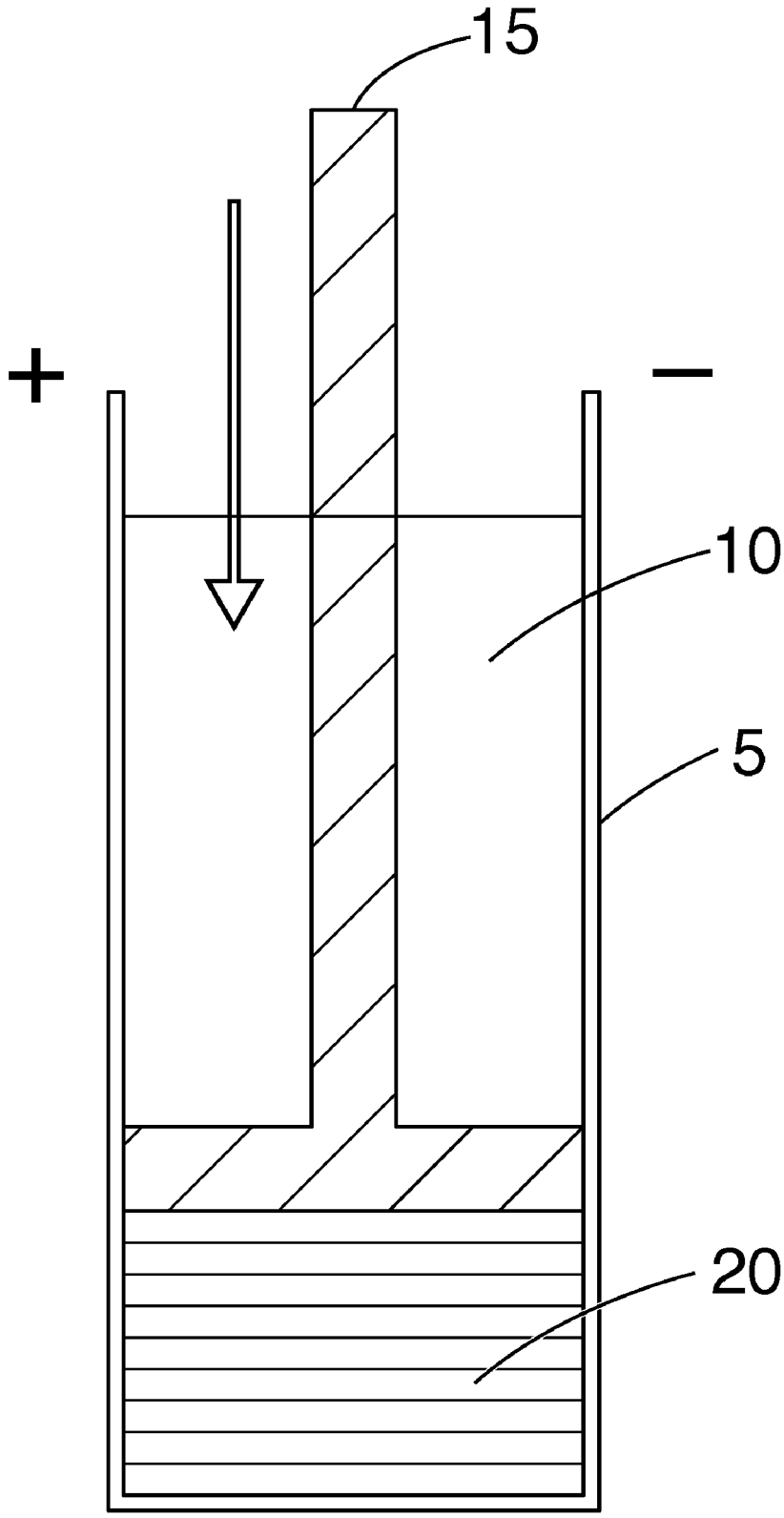
FIG. 3*a* is a schematic representation of an electrofibrilation reactor for in-situ microfiber synthesis and wet press of microfibers into a solid.
Figure 3B:
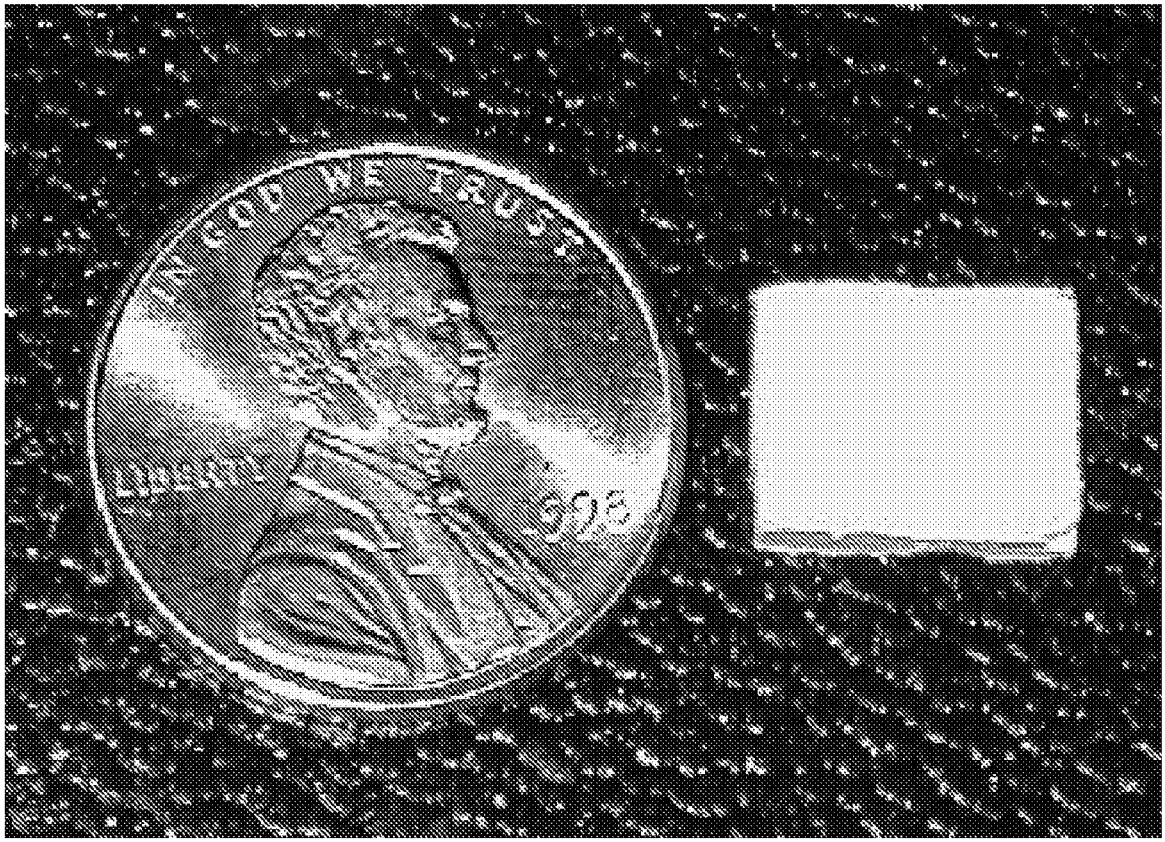
FIG. 3*b* illustrates the size comparison between a penny and a monolith slab containing aligned microfiber structures.
Figure 3C:
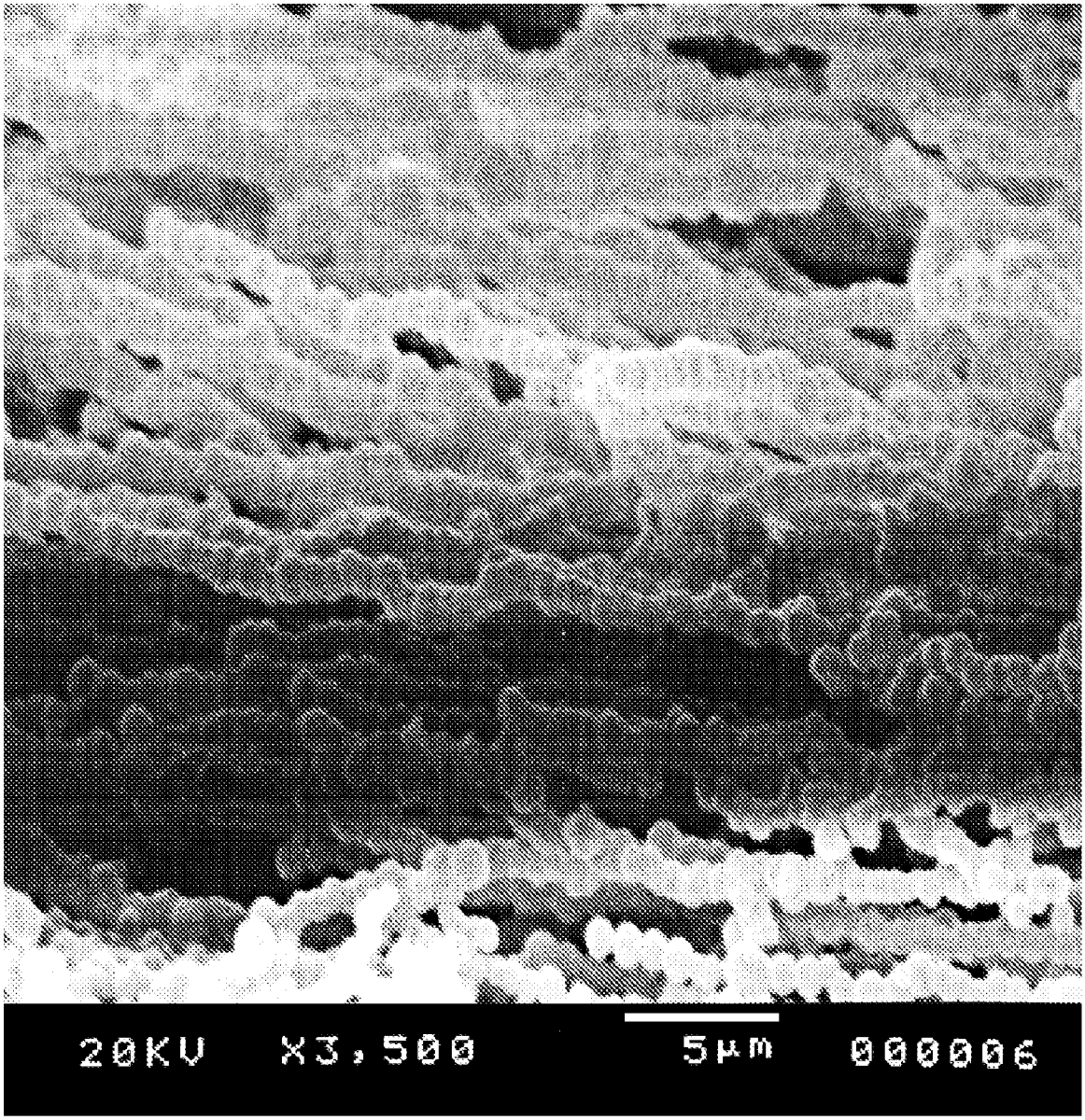
FIG. 3*c* is an SEM micrograph of a monolith material confirming that the microfibers are aligned in one direction in the pressed solid.

To make reasonably sized solid monoliths for practical applications, sufficient mass quantities of aligned microfibers needed to be produced during the precipitation reaction for next-step wet pressing. A larger volume square tube electrofibrilation reactor (10 mm×10 mm×130 mm, 10 mL liquid capacity) was designed and constructed for this purpose. Corresponding to the length of the cells, two long, parallel-plate electrodes (~8 mm spacing) were attached to the inner sides of the reactor walls. Fabrication of monolithic solid was performed by in-situ reactive microfibrilation during hydrolysis/condensation (2-3 hours), followed by "wet-pressing" (see FIG. 3*a* for a schematic set up showing the electrofibrilation reactor 5, solid precipitation reaction media 10, the piston 15 and the solid cake slab 20) of suspended aligned microfibers into a thick solid slab 20 using a Teflon piston 15 under electric field. The piston separated the microfibers (suspended and aligned) from the background solvent and pushed it to the flat bottom of the reactor to form a thick solid cake slab (FIG. 3*b* and FIG. 3*c*). The wet solid slab was dried in air overnight. The dried piece of solid slab was then taken out of the reactor and consolidated by firing in a high-temperature furnace (~1200° C.). SEM examination of monolith materials confirmed that the microfibers are aligned in one direction in the pressed solid (FIG. 3*c*).

Several "wet-pressed" solids (flat square-shaped solid slabs of 1 cm by 1 cm by 3 mm, as shown in FIG. 3*b* for a typical solid monolith as compared with a penny) were obtained in the long square glass tube reactor, using 10 mL of reactive solution (0.2 M TEOS, 5.0 M $H_2O$, and 0.2 M $NH_3$ in tAA, condition 6 in Table 2) with 1.43 kV, 4.5 kHz pulsed DC (approximately an AC signal), ~2 h reaction time. These solid slabs were fired/consolidated at various temperatures in a furnace from about 500° C. to about 1200° C. depending on the thickness of the solid slab monolithic material (Table 3). SEM examination of the internal microstructure of a consolidated solid monolith slab indicated that they mainly contain parallel, aligned microfibers; however, some minor areas showed the existence of randomly-oriented microfibers or round-shaped particles. Therefore, the anisotropic microfibril structure in the pressed solid survived the high-temperature consolidation process. The physical characteristics of several monoliths used for DNA sequencing are summarized in Table 3. The fired monoliths generally show crystobalite crystalline structure per XRD analysis.

TABLE 3

Physical characteristics of solid monoliths used for electrophoretic separation of DNA.

| Monolith Sample# | Dimension | Consolidation/sintering Conditions: Ramp Rate | Max Temp. | Hold Time | Closed density | Bulk density | Open porosity | ^Theoretical density | % Theoretical density |
|---|---|---|---|---|---|---|---|---|---|
| 1 | 1 cm × 1 cm × 3 cm | 5° C./min | 1225° C. | 2.0 hr. | 2.28 | 1.37 | 0.40 | 2.65 | 0.860 |
| 11 | 1 cm × 1 cm × 3 cm | 5° C./min | 1175° C. | 1.0 hr. | 2.23 | 0.38 | 0.83 | 2.65 | 0.842 |
| 12 | 1 cm × 1 cm × 3 cm | 5° C./min | 1200° C. | 1.0 hr. | 2.21 | 0.45 | 0.80 | 2.65 | 0.834 |
| 13 | 1 cm × 1 cm × 3 cm | 5° C./min | 1225° C. | 1.0 hr. | 2.48 | 0.44 | 0.82 | 2.65 | 0.836 |

The present invention demonstrates a totally different concept of fabricating and application of true inorganic monoliths that contain unique anisotropic microstructure (i.e., aligned microfibers). The parallel pores/gaps between the neighboring aligned microfibers or nanofibers in the monolith mimics capillary structure, but could offer tremendously greater numbers of capillaries (and thus, more effective surface areas for functionalized stationary phase) per unit bed volume than the conventional bundled capillary design in capillary electrochromatography. In addition, the present invention offers inorganic monoliths that can offer better separation performance because of their material durability/stability and silica surface chemistry that can be tailored flexibly by grafting various organic ligands. Inorganic materials such as functionalized silica particles have been examined as packing materials inside glass capillaries. The surface chemistry of the monolithic material of the present invention can also be tailored by treating the monolithic surface with a functional group, such as a sulfonyl group or a hydroxyl group.

Figure 3D:
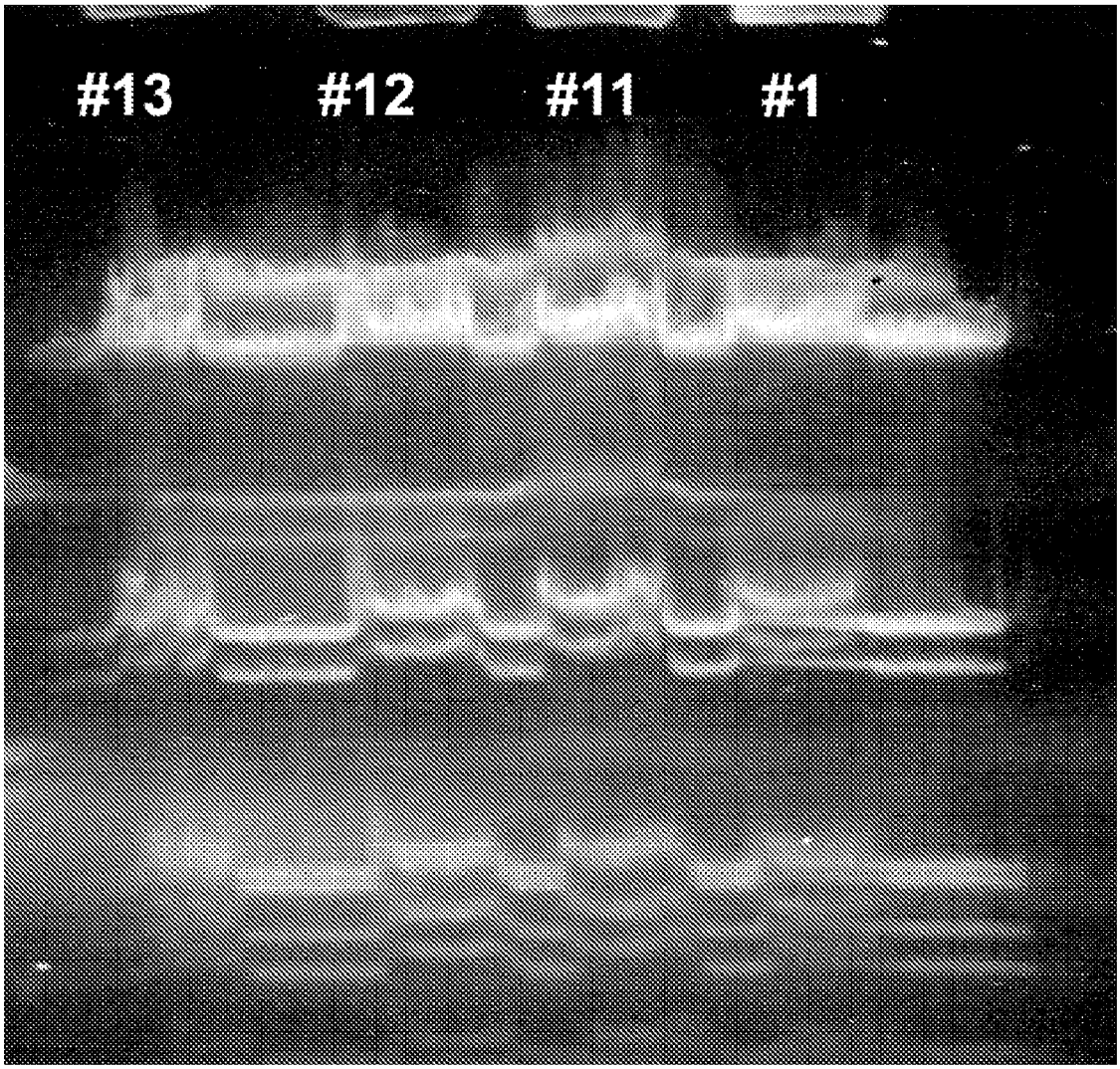
FIG. 3*d* is an SEM micrograph of an electrophoretic separation test showing anisotropic property of monolithic slabs wherein separation is only shown in the x direction and the lanes between the slabs are controls of separation in background agarose gel.

Free from the handling of fragile glass capillaries, or dealing with the complicated packing of capillaries, the anisotropic monolith solid of the present invention can be directly used for separations. The ability of the present invention's silica-based solid monolith slabs (Table 4, labeled as #1, #11, #12 and #13, corresponding to 86.0, 84.2, 83.4, 93.6% of theoretical density, respectively) have been tested to serve as a monolithic medium for DNA separation/sequencing by electrophoresis (e.g. for DNA sequencing application) in order to assess chromatographic properties of monoliths. The phage lambda DNA restricted with EcoRI and HinDIII was separated in the agarose gel, with or without pre-separation on the monolith, in Tris-borate acetate buffer. The monolith slab did not affect DNA migration rate in the Z direction, and only slightly affected DNA migration in the Y direction. The rate of DNA migration was affected in the X direction (along the monolith fibrils, FIG. 3*d* and Table 4), which both indicates the highly directional properties of the material and suggests existing interaction between DNA molecules and the material. The results also point out the increase of the number of theoretical plates due to the interactions of the DNA with the monolith slab. In summary, the DNA electrophoretic separation tests show: 1) the fabricated monoliths of the present invention have anisotropic properties in regards to the retention, interaction, and separation of DNA molecules; 2) DNA and potentially other macromolecules actively interact with the monolith material; and 3) monolith material has properties of a separation matrix in the direction of aligned microfibrils.

TABLE 4

Mobility of different DNA fragments in electrophoretic field along X direction (at 150 V, 169 mA for 163 min.).

| | Retention (migration distance, cm) | | | | |
|---|---|---|---|---|---|
| DNA fragments, bp | Control | #1 | #11 | #12 | #13 |
| 21.2 | 3.9 | 3.8 | 3.8 | 3.8 | 3.85 |
| 5.148/4.973 | 6.85 | 6.55 | 6.45 | 6.5 | ND |
| 4.268 | 7.3 | 7.0 | 7.0 | 7.0 | 7.0 |
| 1.584 | 9.1 | 9.0 | 9.0 | 9.0 | ND |
| 0.947 | 9.7 | 9.5 | 9.5 | 9.5 | 9.5 |

In addition to the monolithic chromatographic separations, the monolithic development of the present invention has potential impact on other applications. Anisotropic materials have enhanced properties, such as conductivity, permittivity, optical attenuation, and mechanical toughening. It has been reported that enhanced dielectric standoff strength perpendicular to the field-aligned fibril directions in the anisotropic monoliths can be expected relative to isotropic solids.

The process of the present invention for producing and growing microfibers, nanofibers and monolith fabrication is not limited to silica materials and can be good for a variety of materials (dielectric or conductive) with various compositions that can be achieved by sol-gel reactions or other solid-precipitative reactions. The greatest feature of the present invention's field-coupled reactive process is that inorganic molecular species and clusters can be manipulated by electric field to achieve the desirable placement (localization) and quantitative accumulation of inorganic materials. One application of this feature leads to new micro- and nano-fabrication technologies such as using patterned microelectrodes or focused electron beam to create high-resolution electrostatic image patterns, which further directs the in situ nucleation and growth of desirable inorganic solid phase. This offers a refined alternative to the bottom-up fabrication based on colloids and smaller particles. Edge roughness of assembled patterns or structures can be much less when the molecular clusters are used as building-block units. Other applications of the monolithic material made by the process of the present invention include not only its use as an electrophoretic media, but also use as a catalyst, an ion exchange resin and in electronics.

The process of the present invention combining pulsed DC electric field (dielectrophoresis) with a sol-gel reaction or other solid precipitative reaction that cause nucleation and growth of solid-phase particles, has been successful in producing long inorganic microfibers, like long hair, with extremely large length-to-diameter aspect ratios, greater than 100:1. Furthermore, anisotropic solid monolithic materials containing aligned microfibers have been fabricated for the first time by the field-assisted "wet-press" process of the present invention. In addition to production of long microfibers, long nanofibers, wires or nanohair have also been produced with appropriate adjustment of the solid precipitative reaction conditions and reaction kinetics.

While there has been shown and described what are at present considered the preferred embodiments of the invention, it will be obvious to those skilled in the art that various changes and modifications can be made therein without departing from the scope of the invention defined by the appended claims.

What is claimed is:

1. An electrophoretic media comprising a solid monolithic material, wherein said solid monolithic material comprises aligned uniform fibrils ranging in diameter from micrometer-sized to nanometer-sized having anisotropic properties including conductivity, permittivity, optical attenuation, mechanical toughening and permeation, said monolithic material further having tailored capillary-like channels ranging in diameter from micrometer-sized to nanometer-sized thereby increasing the volumetric capacity of said monolithic material and said monolithic material having a surface chemistry capable of being tailored for various organic ligand grafting, and wherein said monolithic material has properties of a separation matrix in the direction of said aligned fibrils and further having anisotropic properties in regards to retention, interaction and separation of biomolecules.

2. The electrophoretic media of claim 1, wherein the surface of said solid monolithic material is functionalized.

* * * * *